US006941870B2

(12) United States Patent
McClure et al.

(10) Patent No.: US 6,941,870 B2
(45) Date of Patent: Sep. 13, 2005

(54) POSITIONAL BLASTING SYSTEM

(75) Inventors: Robert McClure, Powell, OH (US); Raphael Trousselle, Auxerre (FR)

(73) Assignee: Advanced Initiation Systems, Inc., Walnut Creek, CA (US)

( * ) Notice: Subject to any disclaimer, the term of this patent is extended or adjusted under 35 U.S.C. 154(b) by 0 days.

(21) Appl. No.: 10/700,412

(22) Filed: Nov. 4, 2003

(65) Prior Publication Data

US 2005/0103219 A1 May 19, 2005

(51) Int. Cl.[7] ..... F42B 3/00
(52) U.S. Cl. ..... 102/311
(58) Field of Search ..... 102/311, 200, 102/217, 215, 312

(56) References Cited

U.S. PATENT DOCUMENTS

| | | | | |
|---|---|---|---|---|
| 3,618,519 A | | 11/1971 | Griffith | |
| 3,903,799 A | | 9/1975 | Walker | |
| 4,324,182 A | | 4/1982 | Kirby et al. | |
| 4,576,093 A | * | 3/1986 | Snyder | 102/200 |
| 4,615,268 A | | 10/1986 | Nakano et al. | |

(Continued)

FOREIGN PATENT DOCUMENTS

| | | | |
|---|---|---|---|
| EP | 0 897 098 A2 | 2/1999 | F42D/1/055 |
| FR | 2 688 583 | 9/1993 | |
| WO | WO 96 16311 | 5/1996 | |
| WO | WO 97 21067 | 6/1997 | |
| WO | WO 00/O4337 A1 | 1/2000 | F42D/1/055 |
| WO | WO 01/86323 A3 | 11/2001 | G01V/1/00 |
| WO | WO 02/31431 A1 | 4/2002 | F42D/1/055 |

OTHER PUBLICATIONS

*International Search Report,* for PCT/US2004/036875 mailed Mar. 9, 2005.

*Primary Examiner*—Teri Pham Luu
*Assistant Examiner*—Jordan Lofdahl
(74) *Attorney, Agent, or Firm*—Wood, Herron & Evans, L.L.P.

(57) ABSTRACT

A blasting system facilitates the actuation of a plurality of programmable detonators according to a desired blasting pattern, to cause the discharge of a plurality of associated charges, by downloading to the detonators blasting information that can be automatically determined by a portable handheld unit that incorporates a positional detecting device, such as a GPS device. The blasting information for any given detonator can be determined by the handheld unit as a function of the distance and the direction of the movement of the unit to the detonator, and/or by the actual GPS location while at the site of the detonator. This automatic determination of blasting information, and particularly the delay times, based on the movement of the unit to the detonator, eliminates error prone human calculations of the delay times needed for multiple detonators at a blasting site. This simplifies the operations and procedures needed for achieving a desired blasting pattern, without sacrificing safety or quality.

6 Claims, 5 Drawing Sheets

U.S. PATENT DOCUMENTS 4,674,047 A 6/1987 Tyler et al.
4,757,764 A 7/1988 Thureson et al.
4,777,880 A 10/1988 Beattie et al.
4,884,506 A 12/1989 Guerreri
4,976,199 A 12/1990 Beukes et al.
4,986,183 A 1/1991 Jacob et al.
5,014,622 A 5/1991 Jullian
5,069,129 A * 12/1991 Kunitomo ..... 102/200
5,090,321 A 2/1992 Abouav
5,117,756 A 6/1992 Goffin, II
5,159,149 A 10/1992 Marsden
5,214,236 A 5/1993 Murphy et al.
5,295,438 A 3/1994 Hill et al.
5,386,780 A 2/1995 Klein
5,388,521 A 2/1995 Coursen
5,447,090 A 9/1995 Adams
5,571,018 A 11/1996 FitzGerald
5,571,985 A 11/1996 Ritter et al.
5,672,840 A * 9/1997 Sage et al. ..... 89/41.01
5,714,712 A 2/1998 Ewick et al.
5,894,103 A 4/1999 Shann
6,014,932 A * 1/2000 Mardirossian ..... 102/200
6,079,333 A 6/2000 Manning
6,082,265 A 7/2000 Sakamoto et al.
6,173,651 B1 1/2001 Pathe et al.
6,283,227 B1 9/2001 Lerche et al.
6,422,147 B1 7/2002 Shann
6,460,462 B1 10/2002 Rosenstock
6,644,202 B1 * 11/2003 Duniam et al. ..... 102/312
2004/0112238 A1 * 6/2004 Talbot ..... 102/200

* cited by examiner

POSITIONAL BLASTING SYSTEM

FIELD OF THE INVENTION

The present invention relates to blasting systems, and more particularly to a blasting system that controls a plurality of detonators to cause a desired blasting sequence, for applications such as mining.

BACKGROUND OF THE INVENTION

Conventional blasting systems rely on a plurality of detonators to controllably fire a complement of associated charges in a desired blasting sequence. The detonators and charges are typically arranged in a plurality of boreholes along and/or around the blasting site. The detonators are interconnected by electrically conductive cables that operatively connect to a blasting machine. In most systems, the blasting machine coordinates detonation of the charges by sending a firing signal to each detonator. Typically, at each detonator the firing signal initiates a countdown from a programmed delay time. A technician programs a desired delay time into each detonator. Generally, the charges then detonate when the counters of their respective detonators decrement to zero.

More specifically, the delay time refers to the lapsed amount of time between receipt of the firing signal and actual detonation. Per conventional operating protocol, the blasting machine is individually or collectively wired to each detonator, and it transmits the firing signal upon verification of the firing lines. The firing signal initializes the counter of each detonator. In response to the firing signal, the counter decrements an amount equal to the downloaded delay time, until detonation of the respective charges.

One or more of such detonators conventionally reside within each borehole of a site designated for blasting. A predetermined pattern of boreholes is typically drilled for a blasting area, according to site conditions and desired performance specifications. These specifications may include rock density, powder factor, fragmentation, excavation, bench height, crushing and vibration considerations, among others. Generally, the detonators have no initial delay time preprogrammed into their memory when placed into the boreholes by technicians.

When programming the delay times using conventional methods, one or more field technicians must find the locations of the boreholes by referring to a map or other plan, and then program the detonators contained therein. Usually, the technicians find and identify the boreholes by sight and/or by stepping off a distance in the field. This practice requires skill, organization and awareness, as a blasting site may include hundreds of largely indiscernible boreholes. Consequently, it is easy for even a seasoned team of technicians to become temporarily disoriented in the field, often requiring them to backtrack and/or to re-do their work. Additionally, the difficulties associated with this conventional practice can frustrate a team of technicians in a blasting operation, and this can create a dangerous situation.

This task may be further complicated in situations when the technicians must calculate the delay times while in the field; based on the locations of the boreholes. Despite the criticality of such calculations and the expertise of most technicians, these field calculations are susceptible to error. Other critical responsibilities of the technicians include logging all of these respective delay times and assuring that proper blasting information has been downloaded to each detonator.

One prior art blasting system, disclosed in U.S. Pat. No. 6,079,333, issued to Manning uses data derived from a GPS (Global Positioning System) to establish a blast program. More particularly, a master controller uses a GPS-based time when detonating an explosive.

Similarly, European Patent Application 0897098 discloses a blasting system that uses GPS position data to calculate delay times for the detonators. This is done at one location, by a central controller. Neither of these prior systems specifically addresses the practical problems faced by technicians in the field that relate to finding and accurately programming a plurality of detonators at a blast site.

It is an object of this invention to reduce or eliminate the errors and/or imprecisions currently associated with conventional methods of programming a plurality of detonators used in a blasting operation.

It is another object of this invention to simplify and facilitate the programming of delay times in a plurality of detonators used in a blasting operation.

It is still another object of this invention to facilitate the logging and tracking of blasting data used for a plurality of detonators at a blasting site.

It is still another object of this invention to make it faster and easier for technicians in the field to find a plurality of boreholes used in a blasting operation.

SUMMARY OF THE INVENTION

The present invention achieves these and other objectives via a blasting system that utilizes a handheld programming unit to locally program a plurality of detonators located in a plurality of boreholes at a blasting site, wherein the handheld programming unit automatically uses positional movement data of the unit itself in order to determine the firing delay times for the detonators. For instance, the programming unit may download a firing delay time automatically determined by the unit as a function of a first detonator's relative proximity to a second detonator, as measured by the distance and direction of movement of the technician from the first detonator to the second detonator. This feature enables the technician to automatically and dynamically field program the timing delays for a plurality of detonators located in boreholes at a blasting site, so that these procedures can be performed "on the fly."

According to one aspect of the invention, the handheld programming unit uses an integrally incorporated Global Positioning System ("GPS") to measure the movement of the technician from one detonator to another. Alternatively, the invention contemplates use of an accelerometer to perform this feature, or any other sufficiently accurate positional measuring device that may be easily and readily used in conjunction with the handheld programming unit.

Additionally, or alternatively, the programming unit may receive a GPS reading at a detonator, to determine and download a delay time based on its actual position. In addition to a delay time, blasting information downloaded by the programming unit typically includes an identifier unique to each detonator, to facilitate in identifying and organizing of the accumulation, the organization and the recalling of the blasting data.

The present invention assists field technicians in precisely locating a plurality of detonators arranged at a blasting site. The present invention also eliminates rework and simplifies the process of programming all of the detonators. This invention facilitates the automatic determination and downloading of desired delay times and other blasting information, while helping to assure technicians that all boreholes and detonators have been accounted for. This helps achieve a desired blasting sequence in an efficient manner, without compromising accuracy or safety.

According to a preferred embodiment of the invention, a plurality of detonators are located in a plurality of boreholes, with each detonator adapted to discharge a desired number of charges. The detonators are also connected by cables to a programmably controlled blasting machine, which controls the blasting operation via blasting signals transmitted along the cables to the detonators. Prior to blasting, a programmable handheld unit is used to automatically determine blasting information, via positional data, to program the detonators with the blasting information and to store the blasting data for each of the detonators. The unit then communicates all of the blasting data to the blasting machine. For instance, the handheld unit is used to download a delay time to a first detonator, and the delay time may be automatically based on the positional determination of the unit at the time of the downloading. The GPS receiver or other position determination mechanism is preferably integral with the programming unit, although it may be separate therefrom in some situations. The programming unit electrically connects to or otherwise communicates with the located detonator to download to the detonator a desired delay time associated with that position, and any other instructions particular to that detonator.

After completing the download of the delay time to the first detonator, the technician moves to a second borehole. During this movement, due to the GPS device incorporated into the programming unit, the unit tracks the direction and the distance of the movement of the technician to the second borehole. The unit may automatically determine the delay time, the loading and the identification data for the next detonator based on the movement of the technician, and/or on the relative position of the second borehole to the first borehole, or even based on another reference position. For instance, the unit may be programmed to increment a downloadable delay time by two milliseconds for each foot traveled in a westerly direction. Similarly, five milliseconds may be added to the delay time for each foot traveled to the north. In this manner, the programming unit can automatically determine accurate blasting instructions on the fly, thereby eliminating the need for field technicians to make complex calculations that are susceptible to error.

At each detonator, the programming unit records the detonator identification number, the downloaded delay time and the GPS positional data. More particularly, the unit stores the detonator identification numbers in connection with the downloaded delay time, and any other information particular to the detonator, including the positional data. The programming unit thus establishes and maintains a comprehensive record of all vital information pertinent to a desired blasting configuration.

The instructions downloaded to each detonator are then communicated back to the blasting machine, as for instance via an RS-32 cable. Preferably this can be done conveniently by setting the programmable unit within a cradle of the blasting machine. The blasting machine retrieves the downloaded instructions from the memory of the programming unit, and all of the actual programming activity of the unit is transferred and processed at the blasting machine. The blasting machine thus retains a complete roster of the detonators by virtue of the uploaded programming unit memory, and this may include positional data.

Thereafter, the blasting machine attempts communication with each detonator prior to initiating a blasting sequence to verify that each detonator is properly connected, unaltered, functional and programmed for detonation. A technician reviews the results of these communications, to identify any potentially problematic boreholes and/or detonators by reference to the identification numbers. Such precaution verifies that all detonators intended for a blast are operational, and that no additional detonators have been mistakenly included. These performance precautions may be further augmented with additional safety features for the blasting system, such as mandating the simultaneous manipulation of both a charge key and a fire switch for detonation.

The programming unit also has application where a Computer Aided Design (CAD) or other design program has been used to map out aspects of a blasting scenario. Such a design may include coordinate approximations and/or identification numbers for each designed/mapped detonator and may be downloaded into the unit prior to programming. Where desired, a technician may use the position determination feature of the programming unit to locate the detonators. For instance, the programming unit may display the positions of the technician relative to the nearest borehole. A determined delay time particular to that hole may also be selectively displayed via the unit. The delay time may be determined as a function of the detonator's actual position, e.g., from positional data taken while the position determination device is located at the detonator.

Notably, the stored information includes the verified positions of each detonator as determined by GPS or other positional system. As an intermediate step, the programming unit may upload a comprehensive picture of the blasting site to a laptop or other computer that is running CAD software. This feature may be particularly useful where a user wishes to rely on the computer to repeatedly update and verify the delay times based upon actual positional data and identification numbers uploaded from the programming unit, as the detonators are being programmed.

These and other features of the invention will be more readily understood in view of the following detailed description and the drawings.

DETAILED DESCRIPTION OF THE PREFERRED EMBODIMENTS

Figure 1:
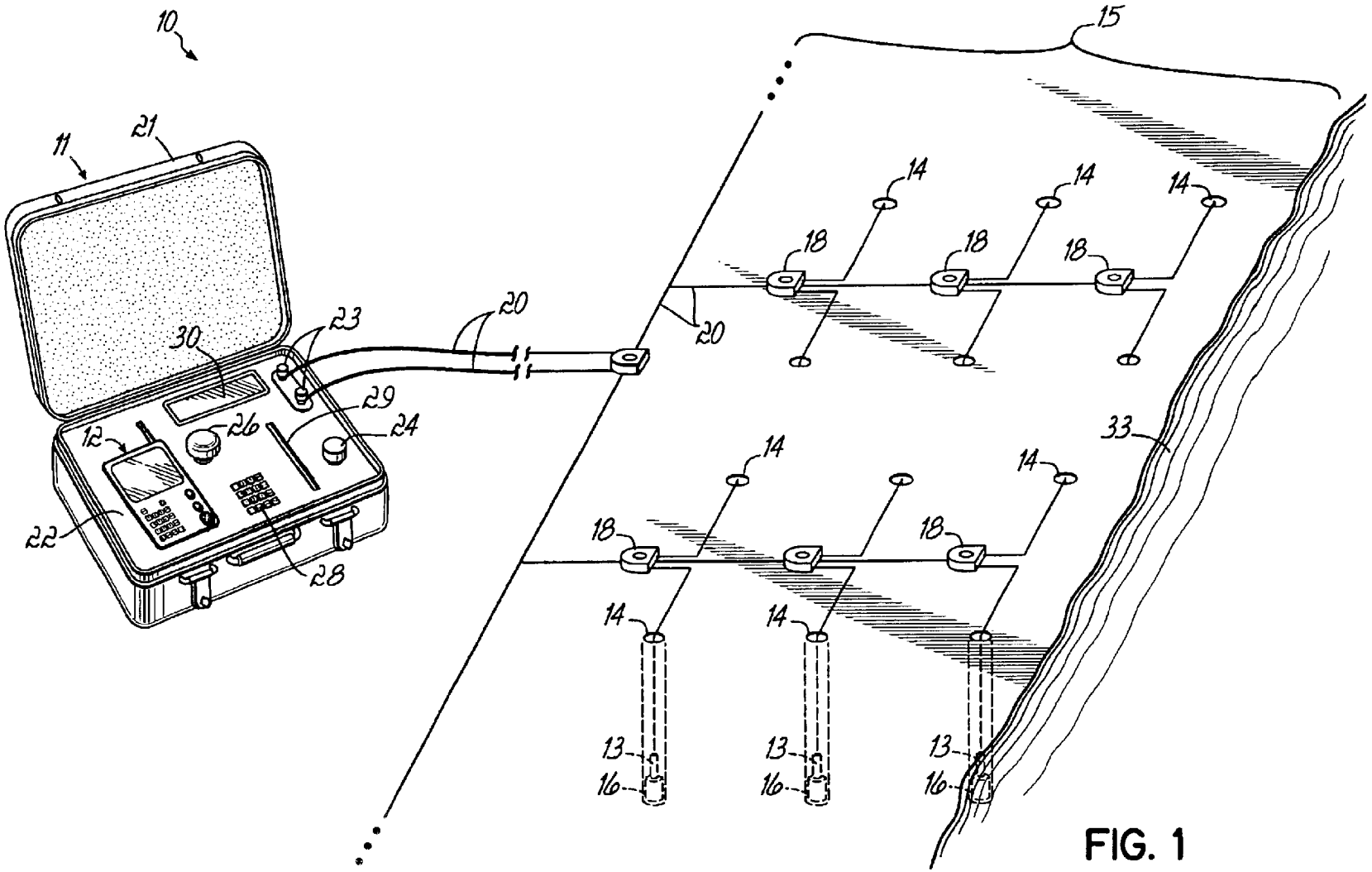
FIG. 1 is a schematic diagram that shows a blasting system in accordance with a preferred embodiment of the present invention.

FIG. 1 shows a position-based blasting system 10 in accordance a preferred embodiment of the present invention.

Generally, the system 10 includes a master controller 11, a handheld programming unit 12 and a plurality of programmable detonators 13 that are located in respective boreholes 14 at a blasting site 15. Each detonator 13 is operatively associated with a number of explosive charges 16. Also, the detonators 13 operatively connect to the blasting machine 11 by connectors 18 and associated cabling 20. Preferably, the blasting machine 11 includes an outer case 21, a cradle 22, connecting terminals 23, a firing switch 24, a charging switch 26, a keypad or other data entry device 28, a disc drive 29, a display 30 and an internal processor (not shown).

The detonators 13 are conventionally programmable detonators capable of receiving blasting information that includes a delay time. The delay time is used for decrementing from a firing signal to a desired blasting time. That is, a delay time refers to a lapsed amount of time between receipt of a firing signal at the detonator 13 and its actual detonation.

Figure 2:
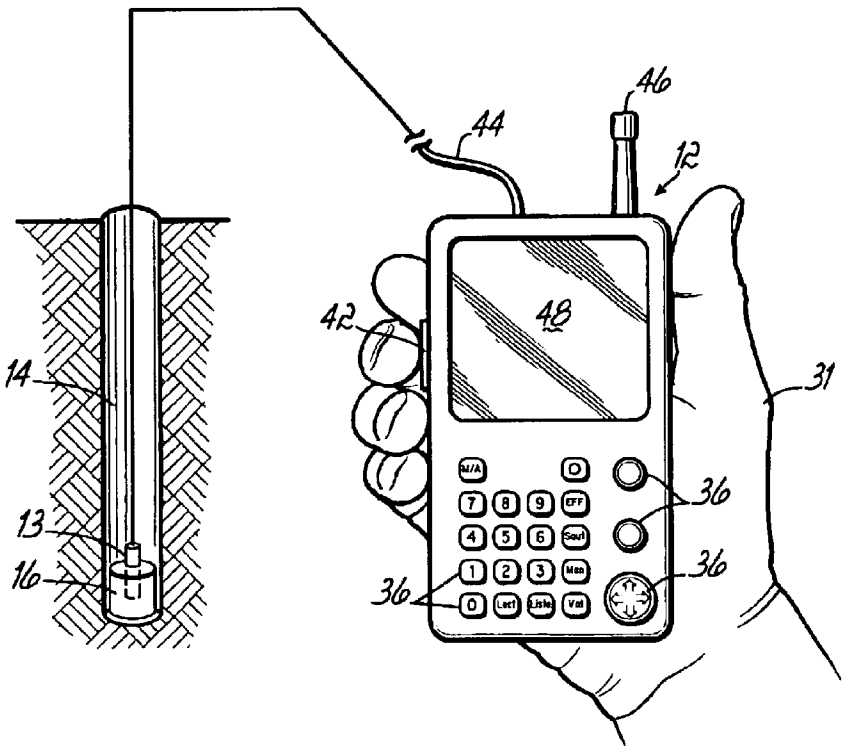
FIG. 2 is a schematic that shows a technician in the field using a programming unit to communicate with a detonator at a borehole at a blasting site.

In FIG. 1, the handheld programming unit 12 is shown resting in the cradle 22 of the blasting machine 11, and the cradle 22 includes electrical connections (not shown) that electrically connect the unit 12 to the machine 11 when placed in the cradle 22. Configured as such, the programming unit 12 can transfer data to and from the machine 11. FIG. 2 shows the programming unit 12 in greater detail.

As shown in FIG. 1, one or more detonators 13 typically reside within each borehole 14 of the area 15 designated for blasting. Each detonator 13 includes a counter (not shown), which decrements an amount equal to the delay time in response to the firing signal. The detonators typically work autonomously once a blasting machine 11, or controller, initiates the firing sequence. This autonomous operation is advantageous for robustness and reliability considerations.

Per application specifications, each borehole 14 may additionally contain decking material, such as stemming and/or explosive products known in the art. FIG. 1 shows an exemplary blasting area 15, in this case a ledge or ridge 33 in located proximate to the boreholes 14. To persons knowledgeable about blasting operations, the word "bench" refers to the blasting area 15. The borehole pattern may be drilled according to site conditions and desired performance specifications such as rock density, powder factor, fragmentation, excavation, bench height, as well as crushing and vibrational considerations, as is known in the art. In accordance with embodiments of the present invention, the boreholes 14 may be automatically drilled by a navigation driller or accomplished manually by a technician.

The detonators 13 of the system 10 shown in FIG. 1 receive the firing signals from a blasting machine 11 via connectors 18 and associated cabling 20. The blasting machine 11 is individually or collectively in communication with one or more of the detonators 13. Although FIG. 1 shows the blasting machine 11 collectively wired to detonators 13, one skilled in the art will appreciate that communications may alternatively be accomplished in a wireless fashion in accordance with the principles of the present invention.

The blasting machine 11 typically coordinates detonation of the detonators 13. For example, the blasting machine 11 may verify the operability of vital equipment, such as igniters and firing energy, while synchronizing counters and energizing all detonators in round via a firing signal. Although the blasting machine 11 shown in FIG. 1 includes sophisticated programming, user interface and communication technologies, one skilled in the art will appreciate that a suitable blasting machine for purposes of this specification may comprise any one of a wide variety of devices that have the ability to effectively execute program and communicate the necessary signals.

The blasting machine 11 sends a firing signal to each detonator 13. For this purpose, the blasting machine 11 typically includes a processor for generating and a port or antennae for communicating the firing signal to the detonators 13. The blasting machine 11 is also equipped with a fully automated self-test feature to ensure proper operation. Such self-testing may include monitoring for open circuits, current leakage, unauthorized reprogramming and overrides, as well as missing and undocumented detonators, among other potential problems.

FIG. 2 shows a schematic perspective view of a technician 31 standing at a borehole 14 with a programming unit 12. Cabling 44 of the programming unit 12 couples to the detonator 13 to enable two-way communication. As such, the unit 12 may program the detonator 13 using Global Positioning System ("GPS"), accelerometer, and/or other position readings. More particularly, the programming unit 12 is in one respect configured to automatically determine and communicate a detonator a delay time that is based upon movement of a programming unit 12. In another or the same embodiment of present invention, the programming unit 12 automatically determines and communicates a delay time based on the actual GPS location of a detonator 13.

To this end, the programming unit 12 may comprise a controller/processor, computer, computer system, or other programmable electronic device capable of receiving and downloading blasting information. The processor of the programming unit 12 typically couples to a memory, which may include supplemental levels of memory, e.g., cache memory, non-volatile or backup memories, read-only memories, etc.

For convenience and practicality considerations, the programming unit 12 shown in FIG. 2 comprises a handheld device. As such, other suitable programming units may include a laptop computer, a pager, a cell phone, or a Personal Digital Assistant ("PDA"), among other processing devices. Moreover, the programming unit 12 may be implemented using multiple computers/controllers, and as described below, multiple programming units 12 may be used in a single blasting operation.

The programming unit 12 may additionally include antenna 46 for receiving and/or transmitting information useful in executing a blasting sequence. Such information may include receiving a GPS signal. An antenna component 46 may additionally have application in downloading information to either, or both the detonators 13 and the blasting machine 11. Other communications using wireless transmission may include those between other programming units 12.

As such, the programming unit 12 may include a position determination device, such as a GPS receiver/transponder. As such, program code may process GPS readings to determine a distance and direction traveled by the receiver. The programming unit 12 of another embodiment may include an accelerometer. An exemplary accelerometer comprises a device configured to generate an electronic output in response to movement. More particularly, the output may be proportional to the inertia/acceleration experience by memory alloys housed within the accelerometer casing. As such, program code of the present invention may process such output to arrive at a relative distance and/or direction traveled by a programming unit 12 having an accelerometer.

The programming unit 12 also typically receives a number of inputs and outputs for communicating information externally. For interface with a technician 31, the programming unit 12 typically includes a user interface incorporating or more user input devices 36 (e.g., a keyboard, a trackball, a touchpad, and/or a microphone, among others) and a display 48 (e.g., a CRT monitor, an LCD display panel, and/or a speaker, among others). As with the blasting machine 11 discussed above, the programming unit 12 may include floppy or other removable disk drive, a hard disk drive, a direct access storage device, an optical and/or infrared communication device (for communication with a detonator, for instance), and/or a tape drive among others. The memory may include a CAD file, such as an as-designed or as-drilled file. Other storage may include a database configured to correlate a detonator 13 to an identifier, delay time, and/or other blasting information. In any case, one of skill in the art will recognize that the inclusion and distribution of memory and programs of the programming unit 12 and other system 10 components may be altered substantially while still conforming to the principles of the present invention.

Furthermore, the programming unit 12 may include an interface 42 and/or 44 with the blasting machine 11 and/or a detonator 13. The programming unit 12 may operate under the control of an operating system and execute or otherwise rely upon various computer software applications, components, programs, objects, modules, data structures, etc. Moreover, various applications, components, programs, objects, modules, etc. may also execute on one or more processors in another computer in communication with the programming unit 12 and/or blasting machine 11. In general, the routines executed to implement the embodiments of the present invention, whether implemented as part of an operating system or a specific application, component, program, object, module or sequence of instructions, or even a subset thereof, will be referred to herein as "program code."Program code typically comprises one or more instructions that are resident at various time in various memory and storage devices in the programming unit 12 or blasting machine 22, and that, when read and executed by one or more processors in a computer, cause that computer to perform the steps necessary to execute steps or elements embodying the various aspects of the invention.

Moreover, while the invention has and hereinafter will be described in the context of fully-functioning controllers, computers, and processing systems, those skilled in the art will appreciate that various embodiments of the invention are capable of being distributed as a program product in a variety of forms, and that the invention applies equally regardless of the particular type of signal-bearing media used to actually carry out the distribution. Examples of signal bearing media include, but are not limited to recordable type media such as volatile and non-volatile memory devices, floppy and other removable disks, hard drives, magnetic tape, optical disks (e.g., CD-ROMs, DVDs, etc.), among others, and transmission type media such as digital and analog communication links.

In addition, various program code described hereinafter may be identified based upon the application within which it is implemented in the specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which programs may be organized into routines, procedures, methods, modules, objects, and the like, as well as the various manners in which program functionality may be allocated among various software layers that are resident in a typical processor (e.g., operating systems, applets, etc.), it should be appreciated that the invention is not limited to the specific organization and allocation of program functionality described herein.

Those skilled in the art will recognize that the exemplary environment illustrated in FIGS. 1 and 2 are not intended to limit the present invention. For instance, one of skill in the art will further appreciate that aspects of the blasting machine 11 may be incorporated into a programming unit 12 where so desired. That is, the programming unit 12 may conduct safety and system integrity checks, for example, as well as generate a firing signal, among other functions. In any case, those skilled in the art will recognize that other alternative hardware and/or software environments may be used without departing from the scope of this invention.

Figure 3:
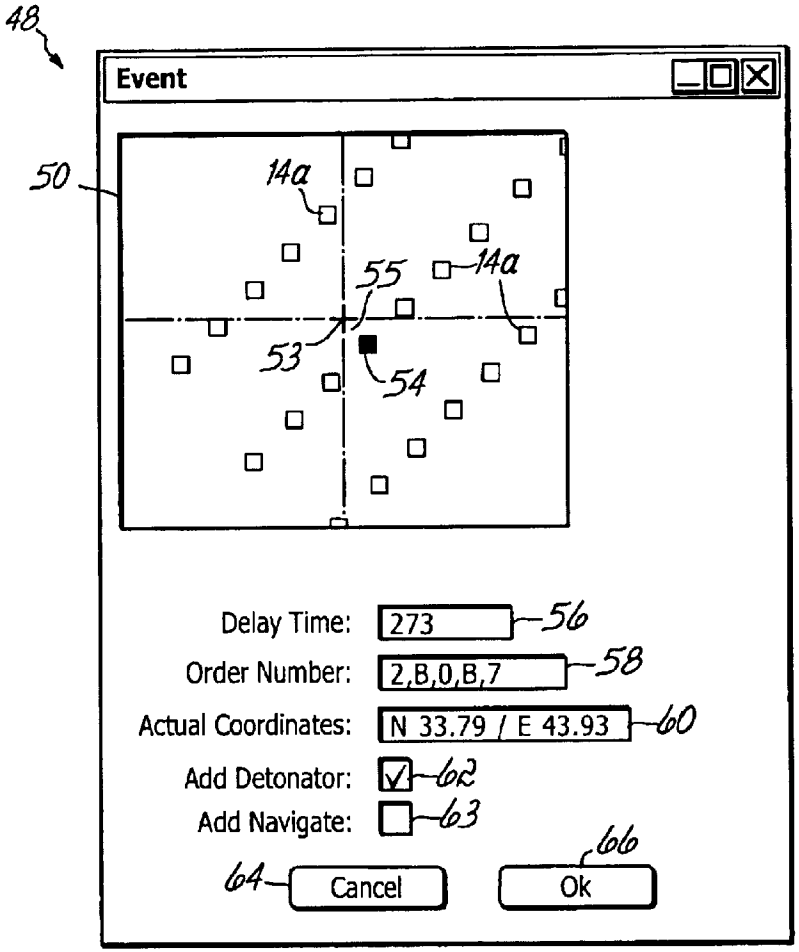
FIG. 3 shows an example of an image that may appear on a display of the programming unit, during the downloading of blasting information to one of the detonators.

FIG. 3 shows an exemplary display 48 having application within the programming unit 12 of FIG. 2. The display 48 includes a CAD display 50 configured to show the position 53 of the programming unit relative to borehole locations 14A. The borehole locations 14A may be preprogrammed into the programming unit 12, or established in the field by a technician 31 using the programming unit 12 as part of a programming sequence. In the case where the borehole locations 14A have been preprogrammed per an as-drilled or other CAD file that has been downloaded into the programming unit 12, the program code may determine to which borehole location 14A the programming unit's location 53 is nearest. For instance, the programming unit in the example of FIG. 3 is nearest borehole location 54. The program code may compare a GPS reading received via the programming unit 12 to coordinates of an expected borehole location 54 to determine the actual location of a detonator 13. Discrepancies between the actual and expected locations may occur due to field conditions during drilling that require change to the expected location 54 of a borehole. Line 55 of the display 50 graphically represents such a deviation. As such, a technician 31 may visually confirm the actual coordinates of a borehole.

The actual location of the borehole will be recorded within memory of the programming unit 12 for later uploading into the blasting machine 11. The exemplary display 48 additionally shows a delay time 56 to be programmed into a detonator 13. An identifier shown at field 58 of the display 48 may additionally be downloaded to the detonator 13 from the programming unit 12. The identifier, or order number/address, may be automatically generated or recalled from memory where applicable. Among other functions, the identifier may be used as a reference for recalling and storing information pertinent to an applicable detonator 13. Field 60 of FIG. 3 includes the actual coordinates of the detonator 13, which are stored in association with the identifier 58 and delay time 56. Other features supported via the exemplary display 48 allow a technician 31 to add a detonator using field 62. Such a feature may assist the technician 31 where a needed detonator has been left off the downloaded design.

Where desired, the display 48 of the programming unit 12 may include navigation features configured to point the technician 31 in the direction of a detonator 13. For instance, a technician 31 may enter a navigation mode of the system 10 by clicking field 63 of the exemplary display 48. Navigation mode may include arrows on the CAD display 50 or the programming unit 12, itself, for graphical manipulation by the technician 31. Cancellation and approval buttons 64 and 66, respectively, allow the technician 31 to modify or confirm entered data. One of skill in the art will appreciate that other display 48 prompts and interface features may be included within another display 48 that conforms to the principles of the present invention.

Figure 4:
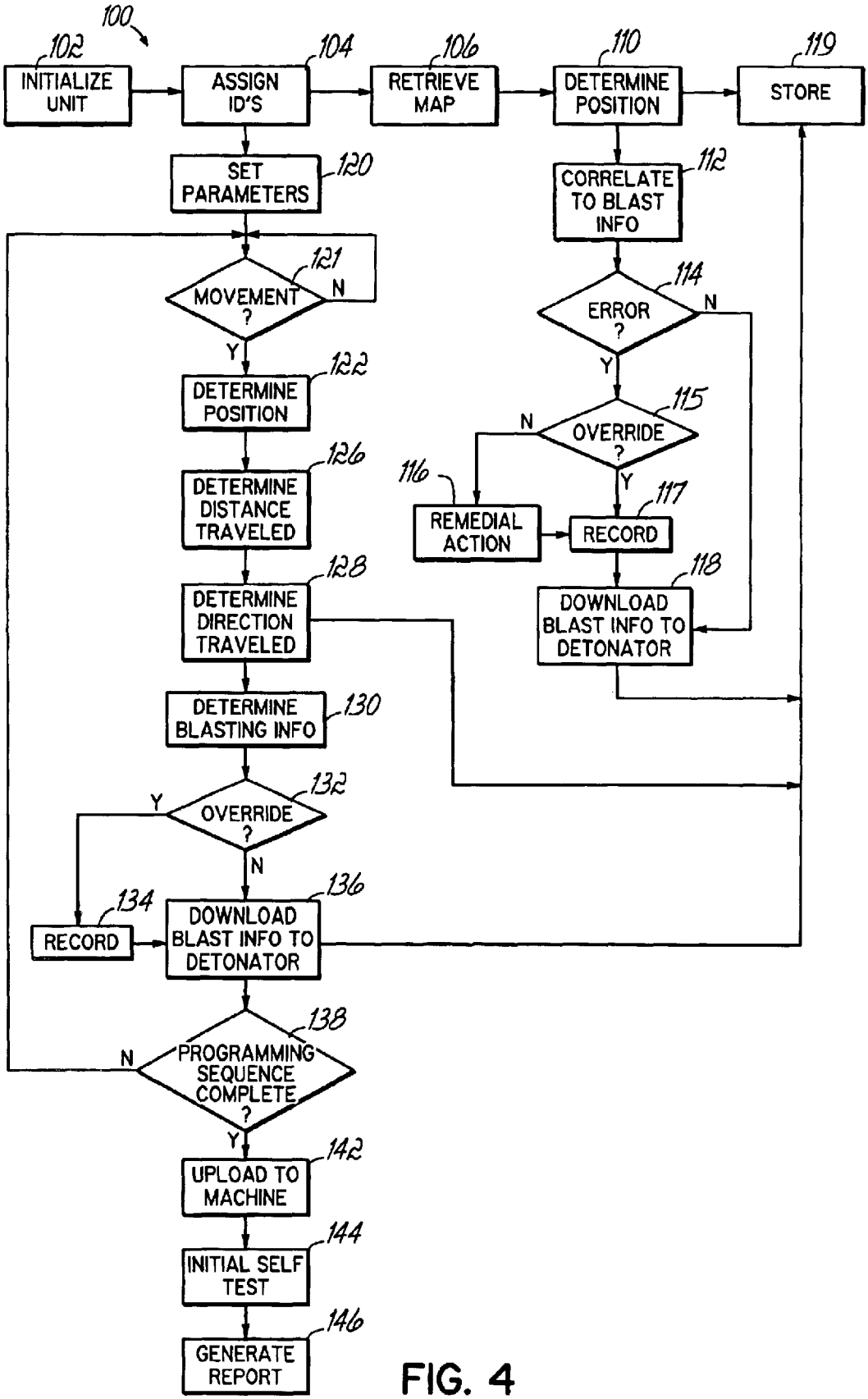
FIG. 4 is a flowchart that shows a sequence of steps suited for programming a plurality of detonators.

FIG. 4 shows a sequence of exemplary method steps suited for execution within the hardware environment of FIG. 1. More particularly, the flowchart 100 of FIG. 4 outlines processes suited to program a detonator 13 according to the movement and/or position of the programming unit 12. As shown by block 102, a technician 31 may initialize one or more programming units 12. Such initialization processes may include verification of the proper authorization codes and functionality of the units 12. Where multiple programming units 12 are used in a blasting operation, unique identifiers may be assigned to the respective programming units 12. For instance, it may be advantageous to program a large bench of detonators 13 by simultaneously using three or more programming units 12 for speed and other efficiency considerations. As such, a first thousand order numbers or other identifiers may be assigned to the first programming unit 12, while subsequent sets of a thousand are assigned to the other two programming units 12. When assigned at block 104, the identifiers may already be associated with a borehole location 14A, or may be automatically assigned by the programming unit 12 to a detonator 13 during a programming sequence as discussed below.

The flexibility and versatility of the programming unit 12 enables it to assist technicians in programming detonators 13 under a variety of circumstances. For instance, where a map of detonators is to be used in a programming sequence, that map may be retrieved by the programming unit 12 along with other blasting information, as shown by block 106 of FIG. 4. Such a map may include an as-drilled file or other electronic file defining detonator locations 14A. As such, the retrieved map typically includes intended coordinates for the detonators 13, which are subsequently stored in the memory of the programming unit 12. Where desired, the map retrieved during step 106 may additionally include pre-assigned identifiers associated with the map coordinates.

Proceeding under these circumstances at block 110 of FIG. 4, the technician 31 may approach a detonator 13 to determine its position using a GPS, accelerometer, or other position determination device of the programming unit 12. This determined position may be stored for future use, as shown by block 119. For instance, the stored, determined position may be upload into the blasting machine 11.

The actual position is correlated to blast information stored with the map, as shown by block 112. For instance, the determined position at block 110 may be associated with the map coordinates to retrieve an order number also associated with the map coordinates. As discussed in detail in connection with FIG. 7, the programming unit 12 may generate a delay time and/or other blasting information in response to any of: the actual position, retrieved order number, or map coordinate. In one embodiment, the map file retrieved during step 106 also includes delay times, which are also retrieved, as shown by block 112. Such blasting information may be displayed to the technician 31 via the display 48 of the programming unit 12.

Should the technician 31 at block 114 object to the displayed blasting information, then the technician 31 may override and enter new information as applicable and as shown by blocks 115 and 116. Such action will be recorded for documentation and accountability purposes, as shown by block 117. In either case, blasting information may be downloaded to the detonator 13, as shown by block 118 of FIG. 4. Block 119 shows the downloaded blasting information being recorded for later use.

Another or the same programming sequence as shown in FIG. 4 may involve determining blasting information based upon the movement of the programming unit 12. Such a feature may allow a technician 31 to create map or other blasting information on the bench and on the fly. Moreover, the technician 31 may generate such blasting information in a manner free from complex planning and mathematical and organizational processes. For example, the technician 31 may set programmatic parameters configured to translate the movement of the programming unit 12 into blasting information, as shown by block 120. In one application, for instance, a technician 31 may stipulate that three milliseconds of time be added to a respective delay time of a detonator 13 for each foot that the detonator 13 is located away from a reference point. Thus, setting of the parameters may include designation of one or more reference points. While a reference point typically includes a detonator location, a suitable reference point may comprise any physical or programmatic object associated with a set of coordinates.

The parameters may further include a directional component. For example, detonators located in an opposite direction relative to a first direction traveled in the above example may have an associated delay time that increments five milliseconds for each foot the programming unit 12 travels in a given direction away from the reference point.

Once these parameters have been established, the programming unit 12 may monitor for movement, as shown by block 121. In response to detected movement, an embodiment of the programming unit 12 may determine the new position, as shown by block 122. That is, the programming unit may utilize GPS, accelerometer or other position indicating technologies to determine the location of the programming unit 12. Using this information in connection with the known location of the reference point, the program code may determine the distance and direction traveled, as shown by blocks 126 and 128, respectively.

The program code may process the distance and direction information as a function of the parameters set during step 120 to determine blasting information, as shown by block 130. Exemplary such blasting information may include delay times. Where applicable, the blasting information may include the actual coordinates of the detonators 13. All of this information is saved after being downloaded to the detonator 13 for use in constructing a comprehensive and final blast plan, which may be uploaded to the blasting machine 11.

The technician 31 may augment or otherwise modify the blasting information as desired, as shown by block 132. Such modification may include altering a delay time. Where so configured, altering of one delay time may affect subsequent delay times. For instance, changing the delay time of a first detonator may cause the delay times of other detonators logically linked to that first detonator to be altered by the same time. For example, increasing the delay time of a first detonator in a given row of detonators by 100 milliseconds may cause the respective delay times of each detonator in that row to automatically increment by 100 milliseconds, or by some other amount determined as a function of the technician's change.

In this manner, the technician 31 may proceed from borehole to borehole without being encumbered by having to have a blast plan already in place. Such a feature is particularly advantageous where data needed to compile an as-designed file is difficult or tedious to obtain. As such, a technician 31 may approach a next borehole 14 and the program code of the programming unit 12 will automatically determine and output a delay time and/or identifier based upon the new detonator's position relative to the reference point. For example, the programming unit 12 may increment a numerical count comprising an identifier in anticipation of the new identifier being downloaded to a next detonator 13 at block 136, along with a determined delay time.

Once the programming sequence is complete, the entire blast plan generated by the programming units 12 may be uploaded to the machine, as shown by block 142. The uploaded blast plan typically includes determined coordinates, identifiers and delay times, in addition to other desired blasting information. Per blasting machine protocol, self-tests may be conducted, as shown by block 144. For instance, the blasting machine 11 may check for non-responsive communication links. Because the programming units 12 have been assigned non-conflicting identifiers during step 104, it is assured that no detonator 13 will be programmed twice. Hard copy reports may be generated for evaluation by skilled personnel and for documentation purposes, as shown by block 146.

Figure 5:
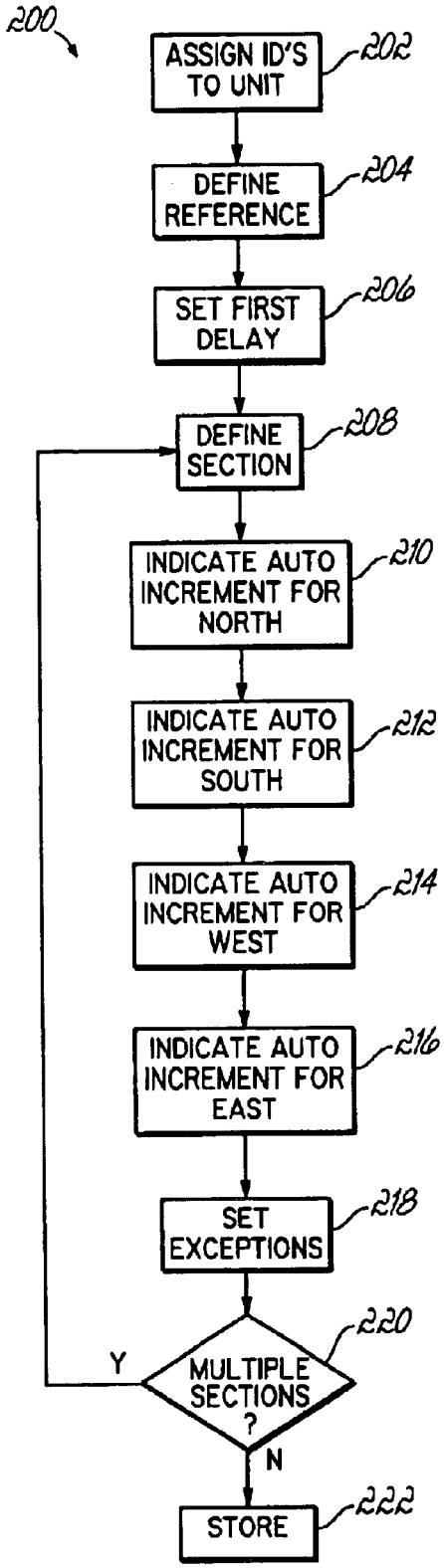
FIG. 5 is a flowchart that shows a sequence of steps for setting the parameters used for discharging the charges according to a desired sequence.

The flowchart 200 of FIG. 5 shows a sequence of exemplary method steps useful in setting the parameters as discussed in connection with block 120 of FIG. 4. Such configuration processes include assigning identifiers to a programming unit 212, as shown by block 202 of FIG. 5. One unique identifier may be assigned to each detonator 13 to facilitate organization and streamlining of a detonation sequence. Where parameters are to be set relative to a reference point, the real or imaginary coordinates of that reference point may be defined by the technician 31, as shown by block 204 of FIG. 5. As discussed herein, the reference point may comprise a set or sets of coordinates. Where so configured, the technician 31 may then designate a first delay time at block 206. For example, a delay time of 150 milliseconds may be set for a first detonator 13, which may additionally comprise the reference point. That first delay time may then be associated with a section, as shown by block 208. A section may comprise one or more detonators. For instance, a section for purposes of this specification may include single detonator, or a row of detonators.

In connection with the section defined during step 208, the technician 31 may stipulate delay time increments, as shown by blocks 210–218. Such increments are typically specific to directions and distances relative to the reference point. For instance, the technician 31 may set the parameters of the programming unit 12 to automatically determine a delay time for a detonator 13 as a function of its relative distance in a northerly direction from the reference point. As such, the technician 31 may specify during step 210 that three milliseconds of delay time be added to the 100 millisecond first delay time set during block 206 for every foot or other distance value that the detonator is north of the defined reference point. Thus, a detonator 13 that is located 200 feet north of a reference point will have a delay time that is 600 milliseconds larger than the first set delay time. Similarly, the technician 31 may set automatic incrementation of delay times for other directions, as shown by blocks 212–216. Where desired, exceptions to these general instructions may be accomplished by the technician 31, as shown by block 218. For instance, such an exception may be mandated by surrounding terrain or as a function of decking material. Where desired, multiple such sections may be accomplished and stored, as shown by blocks 220, 208 and 222.

Figure 6:
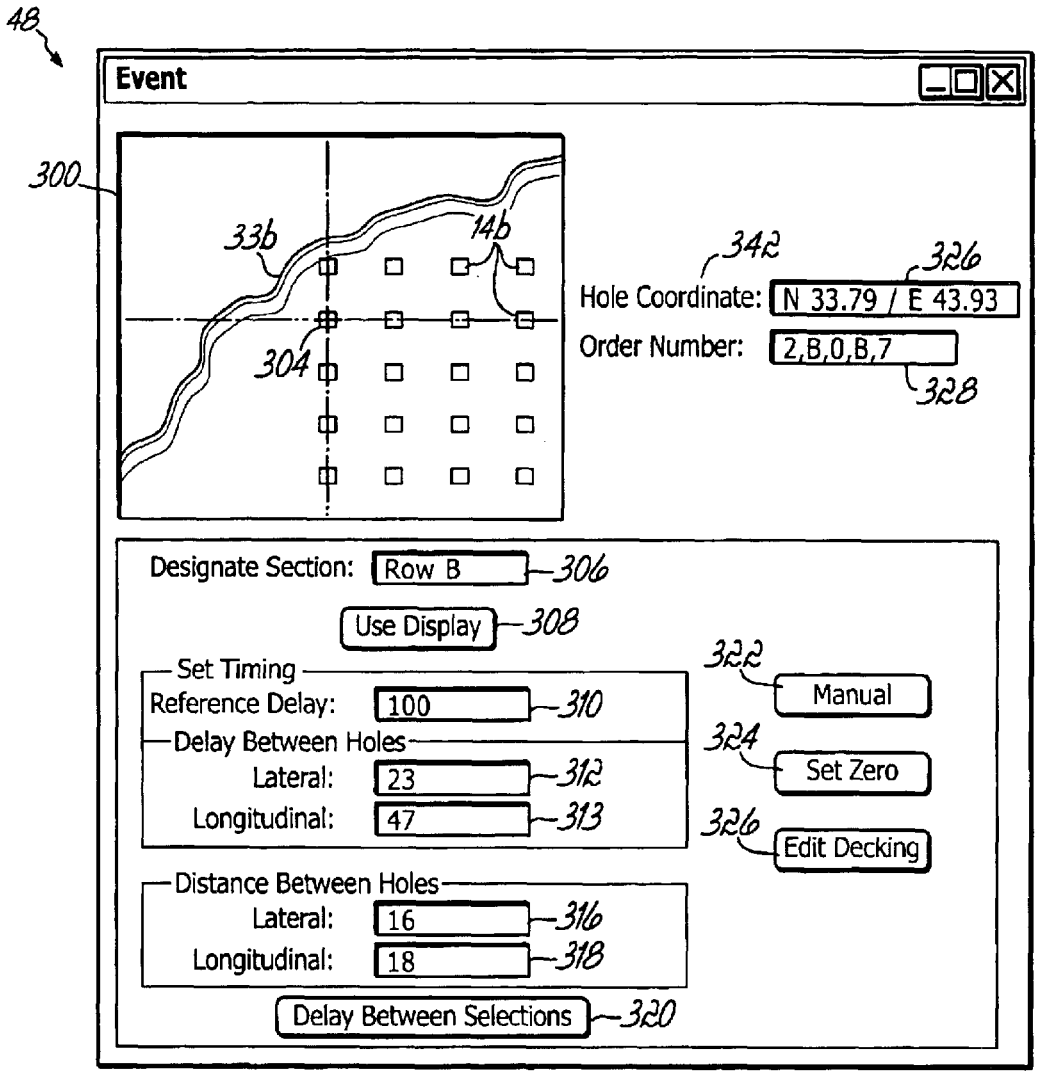
FIG. 6 is similar to FIG. 3, in that it shows the display of the programming unit, but this display differs somewhat in detail, as it corresponds to the sequence of steps of FIG. 5.

FIG. 6 shows an exemplary display 48 configured to accept, prompt and otherwise facilitate the parameter settings discussed in connection with FIG. 5. The display 48 includes an internal display 300 showing the position 304 of the programming unit 12 relative to detonators 14B and a blasting wall 33B. Actual coordinates of a borehole 14B coincident with the programming unit 12 are shown in field 326. As discussed herein, the actual coordinates may be gleaned from a GPS transponder, an accelerometer or another position determination device. Field 328 of FIG. 6 displays an order number, or other suitable identifier. Where so configured, the identifier may be automatically generated and recorded as a technician 31 approaches or stands over a borehole 14. It should be understood that when the specification refers to a technician 31 walking towards a borehole 14, it could alternatively read that the technician 31 is walking towards one or more detonators 13. Moreover, each detonator 13 may be separately programmed in a manner consistent with the principles of the present invention.

The positional display 300 may permit a technician 31 to designate a hole, row, block, or other section using arrow keys, voice commands, touch screen programming, or other known input features. For instance, the exemplary display of FIG. 6 has enabled a technician 31 to designate row B as shown in field 306. This interactive display feature of the internal display 300 may be enabled by the technician's selection of link 308. The technician 31 may alternatively designate a section at field 306 by using a pull-down window or text entry field.

Timing for the designated section may be set at fields 310–318. For instance, the reference delay time may be set at field 310. A reference point may be selected and designated via link/button 324. Delay between the boreholes 14 may be set at exemplary fields 312 and 313. For instance, distance between the boreholes 14 may be set to automatically increment and accumulate 23 milliseconds for every foot in a lateral direction (east or west) from the reference point. Northerly or southerly travel relative the zero/reference point may accrue 47 milliseconds for every foot traveled in the longitudinal direction and relative to the reference point.

Actual distance between the holes may be displayed and recorded at fields 316 and 318. In certain embodiments consistent with the present invention, the program code of the programming unit 12 may automatically adjust delay times where the actual distance between the holes differs from the designed holes. For instance, where a delay time has been predetermined for a given detonator 13 based on an as-designed file, that delay time may be programmatically modified as a function of its actual distance from the reference point varying from its designed distance. Delay times as between different sections, in the present example, between rows, may be accomplished using link 320.

The exemplary display further provides a link 326 for editing decking. Decking pertains to the multilevel positioning of detonators 13 and stemming/explosive material within the borehole 14. Activation of the link 326 may bring up a cross-sectional display of the borehole that may be edited and recorded according to actual deck conditions. Where the technician 31 does not wish for the automatic incrementation of delay times, they may activate the manual mode operation of the programming unit link 322. One of skill in the art will appreciate that another exemplary display may contain and accept additional data per technician 31 specifications and system requirements.

Figure 7:
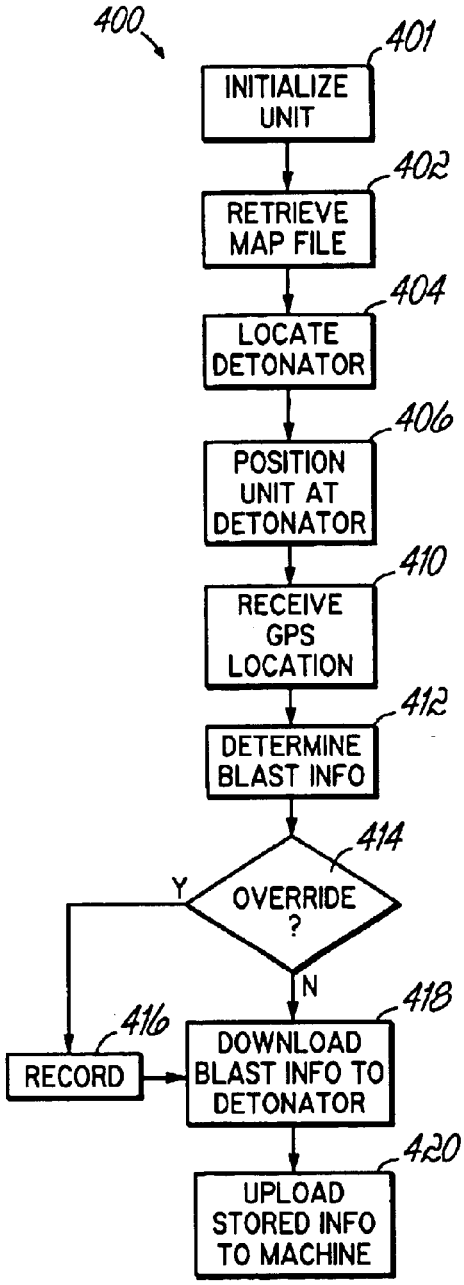
FIG. 7 is a flowchart that shows a sequence of steps for determining blasting information based on the actual position of a detonator, using the programming unit 12.

The flowchart 400 of FIG. 7 shows a series of exemplary process steps for determining blasting information based on a detonator's actual position. At block 401, the technician 31 initializes the programming unit 12. Such initialization processes may include verification of the proper authorization codes and functionality of the units 12, as discussed in greater detail in the text describing FIG. 4. Map and/or other parameter data may be retrieved at bock 402. This information may have already been downloaded into the programming unit 12 in the form of an as-designed file, for instance.

The technician 31 first locates a detonator 13, as shown by block 404. Thereafter, the GPS receiver, which is preferably included within the programming unit 12, is positioned at the actual detonator site, as shown by at block 406. In a typical application, the GPS receiver/programming unit 12 operatively couples to the detonator 13, as shown by block 406. As a result, the GPS location received at that time reflects the actual position of the detonator 13. Block 410 shows the receipt of the actual GPS location data at this point. Thereafter, program code stored at the programming unit 12 may determine a delay time, order number and other blasting information pertaining to the detonator 13, as shown by block 412. For instance, the program code may determine the delay time as a function of the detonator's distance from a particular reference point.

This blasting information may automatically be displayed for the technician 31. Where permitted, the technician 31 may override the determined blast information, as shown by block 414. Any changes to the blasting information downloaded to the detonator at 418 will be recorded at the programming unit 12. Ultimately, the blasting information downloaded and recorded by the programming unit 12 is uploaded to the blasting machine 11, as shown by block 420.

In operation, a technician 31 moves a programming unit 12 to the location of a detonator 13. The programming unit 12 automatically determines blasting information for the detonator, while at the location of the detonator. For instance, the programming unit 12 may determine the blasting information from the movement of the unit 12 over to the actual location of the detonator 13. Alternatively, the programming unit 12 may determine the blasting information from the actual location of the detonator 13 as determined by the program code of the unit 12. The technician 31 then uses the programming unit 12 to download the blasting information to the detonator 13. The programming unit 12 automatically records within its memory the information and particulars surrounding the download of the blasting information. A blasting machine 11 later communicates with the programming unit 12 to receive the contents of the unit's memory. A firing signal from the blasting machine 11 then detonates the detonator 13 according to a desired blasting pattern.

While this application describes one presently preferred embodiment of this invention and several variations of that preferred embodiment, those skilled in the art will readily appreciate that the invention is susceptible to a number of additional structural and programmatic variations from the particular details shown and described herein. For instance, any of the exemplary steps of the above flowcharts may be augmented, replaced, omitted and/or rearranged while still being in accordance with the underlying principles of the present invention. Moreover, while embodiments of the present invention have particular application in the context of mining operations, other preferred embodiments may also have application within the fields of pyrotechnics/fireworks, special effects, civil engineering, seismic research, military, demolition, law enforcement and private security industries, among others. Therefore, it is to be understood that the invention in its broader aspects is not limited to the specific details of the embodiments shown or described. Stated another way, the embodiments specifically shown and described are not meant to limit or to restrict the scope of the appended claims.

We claim:

1. A method for discharging a plurality of charges in a desired blasting pattern at a blasting site, the charges located in boreholes at the blasting site and operatively connected to a detonator associated therewith, comprising:

associating an identifier with each of the detonators;

locating and moving a programmable unit to each of detonators, until all of the detonators have been located and moved to, and while at each detonator:

a) determining a desired delay time; and b) correlating the determined delay time with the respective identifier for the detonator, the determining occurring automatically via a position determining device associated with the programmable unit and based on at least one of the following: the actual location of the detonator as determined by the position determining device, and movement of the position determining device to the actual location of the detonator;

downloading, at each detonator, the determined delay time and the respective identifier correlated therewith;

communicating from the handheld unit to a blasting controller, the downloaded delay times and the identifiers for the detonators;

transmitting, from the blasting controller to each of the detonators, a firing signal thereby to cause each of the detonators to detonate after the lapse of the respective stored delay times to achieve a desired blasting pattern.

2. The method of claim 1 further comprising:

placing the charges in the boreholes in a desired manner at the blasting site;

associating at least one detonator with each of the charges; and operatively connecting the detonators to the blasting controller via electrical cables.

3. The method of claim 1 further comprising:

verifying the operability of the detonators prior to said transmitting, said verifying occurring via the use of position information correlated to the locations of the detonators.

4. The method of claim 1 wherein said determining further comprises:

at a first detonator, incrementing a predetermined delay time by a desired amount based on the distance and the direction moved to said first detonator.

5. The method of claim 1 wherein said communication occurs with the programmable unit residing in a cradle at the blasting controller.

6. A method for locating a first detonator of a plurality of detonators in a plurality of associated boreholes at a blasting site, the method comprising:

retrieving from a memory of a programming unit an identifier associated with a first detonator;

correlating said identifier to an expected location also retrieved from said memory;

receiving from said programming unit positional data indicative of an actual location of said programming unit;

determining directional data indicative of said actual location relative to said expected location; and displaying said directional data to a technician.

* * * * *

UNITED STATES PATENT AND TRADEMARK OFFICE

CERTIFICATE OF CORRECTION

PATENT NO. : 6,941,870 B2 
DATED : September 13, 2005
INVENTOR(S) : Robert McClure and Raphael Trousselle It is certified that error appears in the above-identified patent and that said Letters Patent is hereby corrected as shown below:

Column 1,
Line 61, delete the ";" between "field" and "based" and insert a -- , --.

Column 10,
Line 37, delete the ";" between "128" and "respectively" and insert a -- , --.

Column 14,
Line 24, delete "handheld" and insert -- programmable --.
Line 48, delete "communication" and insert -- communicating --.

Signed and Sealed this

Twenty-eighth Day of March, 2006

JON W. DUDAS
*Director of the United States Patent and Trademark Office*